United States Patent [19]

Wright

[11] 3,970,094

[45] July 20, 1976

[54] HAIR TREATMENT APPARATUS

[76] Inventor: John P. Wright, R.D. No. 1 Lot D-16, Port Deposit, Md. 21904

[22] Filed: Mar. 27, 1975

[21] Appl. No.: 562,654

[52] U.S. Cl. ..... 132/9

[51] Int. Cl.[2] ..... A45D 1/00

[58] Field of Search ..... 132/45 R, 9, 11, 145

[56] References Cited

UNITED STATES PATENTS

| | | | |
|---|---|---|---|
| 1,182,242 | 5/1916 | Bennett | 132/145 |
| 3,272,209 | 9/1966 | Kraus | 132/45 |
| 3,459,197 | 8/1969 | Wilson | 132/11 R |
| 3,877,472 | 4/1975 | Angelo | 132/145 |

*Primary Examiner*—G.E. McNeill
*Attorney, Agent, or Firm*—C. W. Mortenson

[57] ABSTRACT

Apparatus is provided for holding a comb or similar device for treatment of the hair in a fixed position relative to the ear lobe in the first step of its use in parting the hair at a predetermined point. The apparatus includes an arcuate or similar retaining element having a slide member adapted to slide along the length of the arcuate element and a comb is held in a clamp which forms a portion of the slide member. A stationary support or positioning bracket on one end of the arcuate element provides a reference for alignment with the ear lobe. Thus, in use, the stationary bracket is aligned with the top of the ear lobe with the arcuate member extending over the person's head. The comb is previously positioned along the arcuate element so as to effect the desired location of the part in the hair. With this accomplished the whole unit is moved downwardly so as to effect the part by the downwardly moving comb. This apparatus affords a fixed setting of the comb in the slide member to effect the parting of the hair at the same location each time.

8 Claims, 4 Drawing Figures

HAIR TREATMENT APPARATUS

BACKGROUND OF THE INVENTION

This invention relates to a tonsorial apparatus.

The importance of personal appearance cannot be over-exaggerated. To some, however, it is more important than to others. This is particularly true when it comes to effecting the parting of hair, since changing the position of the part line can to a large degree change a person's appearance. When the part is established manually by hit or miss, which is the usual manner, the part line can vary considerably. It is most difficult to establish the part at the same precise location each time.

Accordingly, it is an object of this invention to provide a tonsorial apparatus for use in precisely positioning a device for the treatment of hair.

A further object of this invention is to provide a means of precisely locating a hair treatment device relative to a particular portion of the scalp.

DESCRIPTION OF THE PREFERRED EMBODIMENT

In accordance with the preferred embodiment of this invention, apparatus is provided for use in the treatment of the hair which device includes an arcuate or similar element, a stationary support positioned at one end of said element, and a means for slidably positioning on the arcuate element a means for holding a device used in tonsorial treatments. The stationary support may be adapted to rest on an ear lobe thereby to locate the apparatus relative to the scalp. A means for holding a device such as a comb may be positionable along the length of the arcuate element. Also, the means for holding the device preferably has a longitudinal channel which permits the device used in tonsorial treatments to be snapped into position. A thumb screw in the sliding element may afford the ability to hold the holding means at fixed points along the arcuate element.

BRIEF DESCRIPTION OF THE DRAWINGS

The novel features that are considered characteristic of this invention are set forth with particularity in the appended claims. The invention itself, however, both as to its organization and methods as well as additional objects and advantages thereof will best be understood from the following description when read in connection with the accompanying drawings in which:

DETAILED DESCRIPTION OF THE INVENTION

Figure 1:
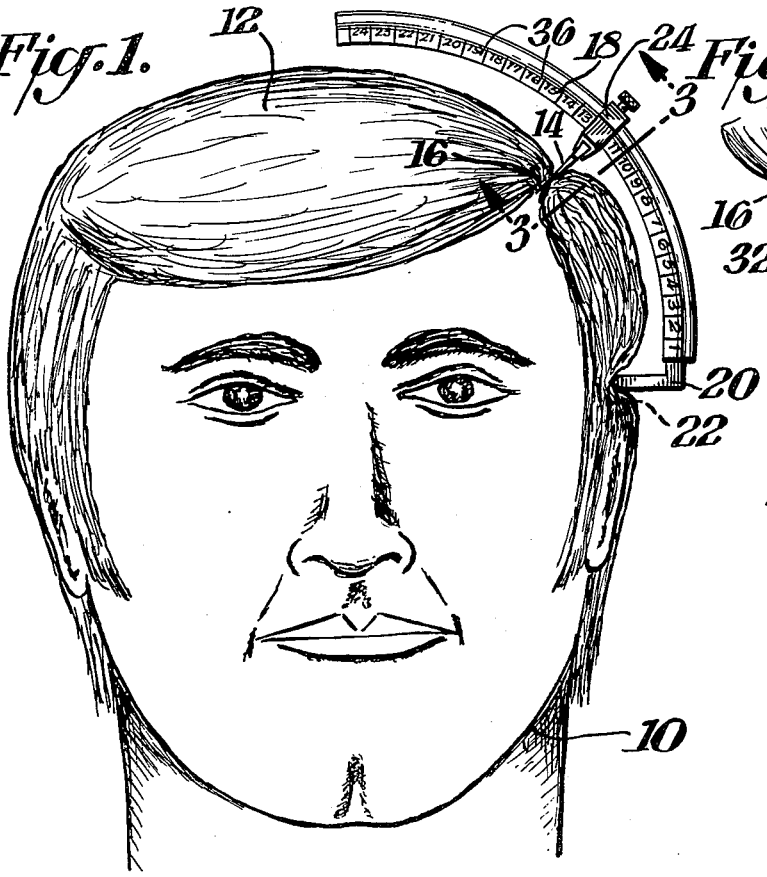
FIG. 1 is a side elevation view of the hair treatment apparatus illustrated in use on a human being.
Figure 2:
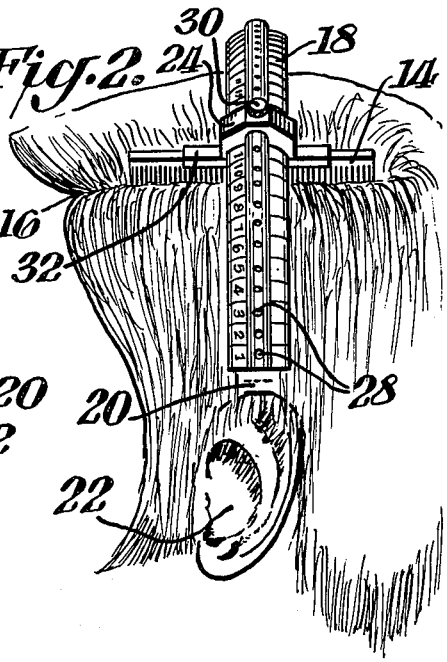
FIG. 2 is a side elevation view of the hair treatment apparatus in use on a human being.

There is seen with particular reference to FIGS. 1 and 2 the illustration of a human head 10 particularly showing the hair 12. According to this invention the device described permits the holding of a comb or other device used in tonsorial treatments in a fixed position relative to the human head. The application depicted in FIGS. 1 and 2 is that of a comb 14 which is used to effect parting of the hair at a particular point 16.

The apparatus of this invention for holding the comb 14 includes an arcuate element or support 18 which has a stationary support or bracket 20 at the lower end thereof. The stationary support 20 may be L-shaped or of any other convenient shape and may be unitary with or attached to the arcuate member by any suitable means such as molding or welding. The stationary bracket 20 is adapted to engage the top of the ear lobe 22 such that the arcuate element 18 will assume a fixed position relative to the human head 10 and hair 12 as it is held in the hand of the user applying the device.

Figure 3:
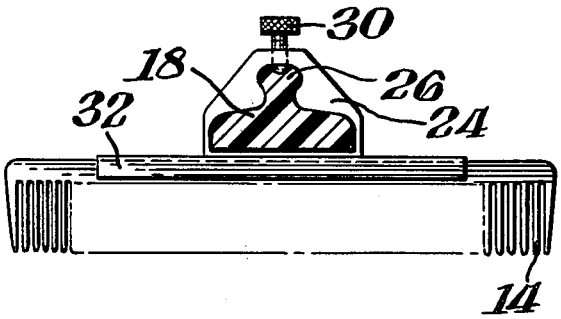
FIG. 3 is a cross-sectional view of the hair treatment apparatus taken along the section line 3—3 particularly showing the manner in which the hair treatment device is held.
Figure 4:
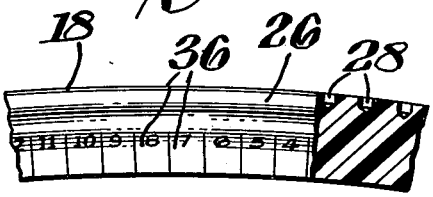
FIG. 4 is a fragmentary view of the arcuate element which forms a part of the hair treatment device partially cut away to illustrate the locking sockets which aid in positioning the slide member along the arcuate member.

A slide member 24 is adapted to the cross-sectional configuration of the arcuate element 18 so that it may slide along the length of the arcuate element. The outer portion of the arcuate element 18 has an enlarged bead-like portion or track 26, as seen in FIG. 3, which aids in permitting the slide element to track properly along the arcuate element 18. In the outer portion of the track 26 there are formed a plurality of sockets or receptacles 28, as shown in FIG. 4. These sockets or receptacles are adapted to receive the tip of a thumb screw 30 which threadedly engages the slider and is adapted to pass through the outer portion of the slider into the various sockets or receptacles such that the slider may be positioned at a number of fixed points along the length of the arcuate member and adjusted simply by releasing the thumb screw and moving the slider to a different position and readjusting the thumb screw, the said engaging being shown in FIG. 3. A member 32 affording a channel is secured by any suitable means such as welding to the bottom portion of the slide member 24. This locking channel 32 preferably is formed of a spring-like material such as spring steel such that the arms of its U-shaped configuration are biased inwardly such as to grip a tonsorial device such as a comb 14. Preferably, the tonsorial device or comb 14 has an enlarged head portion and is tapered downwardly from that point toward the teeth of the comb such that the locking channel 32 may with greater facility grip the comb.

Scale markings 36 may be positioned along the side of the arcuate element 18 so as to provide an indication as to the various settings that the user may wish. While an arcuate shape is preferred for element 18, other shapes can be used. However, angular or rectangular shapes do not bring the parting device into the sharp, perpendicular relationship of the parting device to the head as well as does the arcuate shape.

The components of this invention preferably are made of metal although other suitable rigid material such as plastics may be used as desired. In most cases, however, the tonsorial device or comb will be formed of plastic although metal may be used here also.

In use the comb 14 is inserted into the locking channel 32 which provides a snap-on or ball-socket type connection, not shown for convenience, the springiness of the sidewalls of channel 32 being relied on for the snap-on connection, such that the comb is held in a manner generally perpendicular to the arcuate element. The slide member 24 is positioned along the arcuate element with the aid of the scale 36 to the desired location relative to the stationary support 20 at the end of the arcuate element and relative to the desired location of the part. The thumb screw is then turned to engage the particular slot or receptacle at that scale position. In this connection it is noted that the sockets 28 in the element 18 may be omitted as desired. In the event they are omitted, the adjustment or positioning of the slide member 24 along the arcuate element is infinite. However, the sockets are preferred since they render the adjustment at the incremental or fixed positions more easily and with a more positive locking action. When there are no sockets, the end of thumb screw 30 simply bears down on the top portion of element 26.

With the slide member in position, the stationary support 20 is now held positioned at the top of the ear lobe or some other fixed location convenient to the user with the arcuate element extending over the head. The teeth of the comb 14 are now pressed into the hair 12 and the arcuate element rocked so that the stationary support clears the ear lobe. The entire unit is then drawn downwardly so as to draw the strands of hair 12 via the comb 14 downwardly and thereby establish the part. By retaining the same setting of the slide member, the part in the hair may be precisely located time after time, use after use.

In alternative embodiments a brush may be substituted for the comb. In the use of a brush, the brush usually has an enlarged or knurled bead along the top portion thereof to permit it to be engaged by the locking channel 32. In still other alternative embodiments, the locking channel may be omitted and other suitable fastening means utilized as desired although the locking channel is preferred because of its simplicity and ability to snap the comb or other tonsorial device into and out of position.

There has thus been described a relatively simple tonsorial device capable of precisely locating a point on the person's scalp so as to permit reproducible results.

It is obvious that many embodiments may be made of this inventive concept, and that many modifications may be made in the embodiments hereinbefore described. Therefore, it is to be understood that all descriptive material herein is to be interpreted merely as illustrative, exemplary and not in a limited sense. It is intended that various modifications which might readily suggest themselves to those skilled in the art be covered by the following claims, as far as the prior art permits.

I claim:

1. An apparatus for use in the treatment of hair comprising a retaining arcuate element spanning at least a portion of the human head and having slidably mounted thereon a device for treating said hair; positioned at one end of said arcuate element a positioning bracket adapted to rest on the top of an ear to align said hair-treating device in a desired position; and slidably positioned on said arcuate element a means for holding in a fixed position said hair-treating device.

2. An apparatus in accordance with claim 1 in which said hair-treating device is a comb.

3. An apparatus in accordance with claim 1 in which said slidable holding means includes a means for keeping it in a fixed position relative to said retaining element.

4. An apparatus in accordance with claim 1 in which said retaining element contains a plurality of sections each of which affords fixing said slidable holding means in desired location.

5. An apparatus in accordance with claim 1 in which said holding means for said hair-treating device contains a longitudinal channel into which said device may be inserted.

6. An apparatus in accordance with claim 3 in which said keeping means comprises a set screw adapted to co-act with said retaining element in effecting said keeping.

7. An apparatus in accordance with claim 5 in which said channel affords a snap-on connection for receiving a co-acting snap-on connection contained on said device.

8. An apparatus in accordance with claim 5 in which said channel is positioned substantially perpendicular or as a radius to said retaining element.

* * * * *